US007931504B2

(12) United States Patent
Schiessl

(10) Patent No.: US 7,931,504 B2
(45) Date of Patent: Apr. 26, 2011

(54) ELECTRICAL CONNECTOR

(75) Inventor: Johann Schiessl, Bodenwoehr (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/387,581

(22) Filed: May 5, 2009

(65) Prior Publication Data

US 2009/0280692 A1 Nov. 12, 2009

(30) Foreign Application Priority Data

May 8, 2008 (DE) ..... 10 2008 022 610

(51) Int. Cl.
*H01R 24/00* (2011.01)

(52) U.S. Cl. ..... 439/676

(58) Field of Classification Search ..... 439/676, 439/677–680, 189, 284
See application file for complete search history.

(56) References Cited

U.S. PATENT DOCUMENTS

| | | | | |
|---|---|---|---|---|
| 3,086,188 | A * | 4/1963 | Ross | 439/291 |
| 5,362,257 | A * | 11/1994 | Neal et al. | 439/676 |
| 5,362,258 | A * | 11/1994 | Arnswald et al. | 439/695 |
| 5,399,107 | A * | 3/1995 | Gentry et al. | 439/676 |
| 5,603,044 | A | 2/1997 | Annapareddy et al. | 395/800 |
| 6,089,923 | A * | 7/2000 | Phommachanh | 439/676 |
| 6,146,209 | A * | 11/2000 | Francis | 439/676 |
| 6,419,527 | B2 | 7/2002 | Reichle | 439/676 |
| 6,638,121 | B1 * | 10/2003 | Walker et al. | 439/885 |
| 6,840,779 | B2 * | 1/2005 | Eberle et al. | 439/76.1 |
| 6,916,209 | B1 * | 7/2005 | Casher et al. | 439/676 |
| 7,040,925 | B2 * | 5/2006 | Beerwerth et al. | 439/620.02 |
| 7,121,852 | B2 | 10/2006 | Ng et al. | 439/131 |
| 7,255,587 | B2 | 8/2007 | Boeck et al. | 439/358 |
| 2001/0021608 | A1 * | 9/2001 | Borbolla et al. | 439/676 |
| 2002/0090861 | A1 | 7/2002 | Kunick et al. | 439/676 |
| 2003/0011375 | A1 * | 1/2003 | Deleu et al. | 324/457 |
| 2003/0119372 | A1 * | 6/2003 | Aekins | 439/676 |
| 2004/0121819 | A1 | 6/2004 | Vogel | 455/569.2 |
| 2004/0203292 | A1 * | 10/2004 | Eberle et al. | 439/676 |
| 2005/0253662 | A1 * | 11/2005 | Seefried | 333/1 |
| 2007/0105452 | A1 * | 5/2007 | Gerlach et al. | 439/676 |
| 2007/0287332 | A1 * | 12/2007 | Gordon et al. | 439/607 |
| 2008/0050965 | A1 | 2/2008 | Szelag et al. | 439/387 |
| 2008/0311778 | A1 * | 12/2008 | Aekins | 439/344 |

(Continued)

FOREIGN PATENT DOCUMENTS

DE 101 03 610 A1 8/2002

(Continued)

OTHER PUBLICATIONS

Symphony, Technical Information 30/72-2181-DE; pp. 7 to 14 (See Statement of Relevance), dated Nov. 2000.

*Primary Examiner* — T C Patel
*Assistant Examiner* — Harshad C Patel
(74) *Attorney, Agent, or Firm* — Davidson, Davidson & Kappel, LLC

(57) ABSTRACT

An electrical connector includes a plug (20) and a socket (40). The plug (20) and the socket (40) have identical numbers of at least two plug contacts (201 to 208) and at least two socket contacts (401 to 408). At least two of the plug contacts (201 to 208) and at least two of the socket contacts (401 to 408) are conductively connected.

8 Claims, 4 Drawing Sheets

U.S. PATENT DOCUMENTS

| | | | | |
|---|---|---|---|---|
| 2008/0311797 | A1 * | 12/2008 | Aekins | 439/676 |
| 2009/0298344 | A1 * | 12/2009 | Pyczak | 439/629 |

FOREIGN PATENT DOCUMENTS

| | | | |
|---|---|---|---|
| DE | 101 13 529 | A1 | 9/2002 |
| DE | 101 27 292 | A1 | 12/2002 |
| DE | 101 37 703 | A1 | 2/2003 |
| DE | 696 20 497 | T2 | 12/2003 |
| DE | 10 2004 038 123 | B4 | 2/2006 |
| DE | 10 2005 040 064 | A1 | 4/2006 |
| DE | 100 53 843 | C1 | 6/2006 |
| DE | 10 2005 060 798 | A1 | 6/2007 |
| DE | 10 2006 039 799 | B3 | 11/2007 |
| DE | 601 24 727 | T2 | 9/2009 |
| EP | 1310 019 | B1 | 5/2003 |
| EP | 1 128 494 | A1 | 8/2007 |
| WO | WO 02/075859 | | 9/2002 |
| WO | WO 2008/006402 | A1 | 1/2008 |

* cited by examiner

ELECTRICAL CONNECTOR

CROSS REFERENCE TO RELATED APPLICATIONS

This claims priority of German Patent Application No. 10 2008 022 610.6, filed on May 8, 2008 and hereby incorporated by reference herein.

BACKGROUND OF THE INVENTION

The present invention relates to an electrical connector including a plug and a socket.

The RJ45 plug has become the established standard for Ethernet networks. The connecting technology consisting of socket and RJ45 plug is specified according to IEC 60603-7, 11-1996.

The abbreviation RJ is short for "Registered Jack", wherein "connector" may be used instead of "jack". Such connectors are also referred to as "Western plugs" and include a series of plugs developed in the United States, which were initially used for connecting telephones only.

In addition to the 4-pole variants RJ11 and RJ14, RJ45 is the American technical term for the 8-pole Western plug. In Germany, it is mainly used for connecting ISDN terminals to the S0 bus, as well as in Ethernet or ATM LAN applications and hubs.

German published application DE 101 37 703 A1 discloses a plug-in connector having redundant soldered, welded or other connections. The disclosed plug-in connector is, for example, provided for connecting electromagnetic actuators, although it does not have a defined standard.

German patent application DE 10 2005 060 798 A1 discloses a plug connector for Ethernet connections consisting of a socket and a plug, wherein the plug connector is compatible with RJ45 such that a known RJ45 standard plug may be plugged into the socket. The patent application further discloses two additional power contacts via which a supply voltage may be transmitted. The contacts for voltage transmission are positioned next to the contacts for data transmission.

A similar plug-in connection is disclosed in patent document DE 100 53 843 C1. It is also a plug-in connection designed according to the RJ45 standard, wherein the additional power contacts for the voltage supply are arranged in the upper portions of the plug and the socket. Redundant interconnection between the contacts is not provided.

There are further disclosed techniques which are supposed to ensure the transmission of electrical data signals by means of structural modifications or additions to the plugs and/or sockets of the connectors. The published application DE 101 13 529 A1 discloses a plug-in connector using a standard RJ45 plug that is locked to the socket by a lock. This structural addition to the socket is supposed to ensure that the plug cannot become detached from the socket.

A further mechanical lock for securing an RJ45 plug is disclosed in patent document DE 10 2004 038 123 B4. The housing of the plug is prevented from slipping out of the socket by a latching element. The plug is further provided with a closure piece preventing undesired opening of the plug so that the electrical connections cannot be manipulated.

The German translation of European patent document DE 601 24 727 T2 discloses a technique connecting the housing halves of a plug to each other and simultaneously fixing the cable. This object is achieved by a rotatable clamping ring at the end of the plug. By turning the clamping ring, the housing halves are connected to each other such that they can no longer be opened. The rotation of the clamping ring further narrows the cross-section at the location where the cable enters the plug. Due to the narrowed cross-section, the insulation of the cable is compressed and the cable is fixed.

European patent application EP 1 128 494 A1 discloses an adapter and a plug to be used in communication and control networks. Several sockets are provided in the adapter to allow the connection of several devices, such as telephone, fax machine and network, within a small space using the available copper cables. The adapter is designed such that various types of plugs, preferably plugs according to the RJ45 or RJ11 standards, may be used.

German patent document DE 10 2006 039 799 B3 describes a plug according to the RJ45 standard consisting of two housing halves pivotably connected to each other. As the plug consists of several housing halves connected by a hinge mechanism, the plug may be quickly opened and closed. The plug is further designed such that it may be opened and closed without any tools. A further embodiment describes a mechanism by which the conductors of the cables may be easily connected to the plug. By closing the housing halves, the contact elements are pressed through the insulation of the conductors and the electrically conductive connection between plug and line is established.

SUMMARY OF THE INVENTION

It is an object of the invention to provide an electrical connector for secure, robust and undisturbed data transmission, preferably for industrial applications.

This object is achieved by an electrical connector comprising: a plug provided with a cable; a socket provided with a cable, wherein the plug and the socket have an identical number of at least two plug contacts and at least two socket contacts; and an electrical conductive connection between at least two plug contacts and an electrical conductive connection between at least two socket contacts.

The inventive electrical connector is a connector primarily ensuring secure signal and/or data transfer. The electrical connector includes a plug and a socket. The plug and the socket each have an identical number of at least two contacts. The plug and the socket are each provided with a cable, the cables having identical numbers of conductors. A special feature of this embodiment is that at least two contacts in the plug and at least two contacts in the socket are conductively connected.

In a further embodiment, the plug and the socket each have eight contacts for signal and/or data transmission. This embodiment may be used for transmitting signals and/or data in Ethernet networks or in controls. Various embodiments having eight or less contacts are known and used for connectors employed in Ethernet networks.

The preferred embodiment of the plug is the interconnection of always any two of the plug contacts to form a plug contact pair, wherein the two interconnected plug contacts transmit the same signal in parallel. In previous plugs, the first contact, the second contact, the third contact and the sixth contact are each connected to a conductor of a cable. In the plug of the present invention, the first plug contact and the fourth plug contact, the second plug contact and the fifth plug contact, the third plug contact and the seventh plug contact, and the sixth plug contact and the eighth plug contact are conductively connected to each other in pairs. This interconnection ensures that the signal and/or data stream is transmitted even if one contact of the paired, interconnected contacts does not have an electrically conductive connection.

The matching element for the plug is a socket whose contacts are interconnected analogously to the plug contacts. The interconnection of the socket contacts ensures that the signals and/or data transmitted from the plug to the socket are securely transmitted. The interconnection of the socket contacts further prevents signal and/or data loss in case of failure of a socket contact.

The embodiments described above are preferably realized by connecting an electric cable to each of the plug and the socket, the cables comprising fewer conductors than there are plug and/or socket contacts. This requires at least two contacts to be connected to each other. The potential combinations for interconnecting the plug and/or socket contacts depend on the number of conductors provided by the cable.

In one embodiment for the 10/100 Mbit Ethernet technology, the cables for the plug and the socket each have four conductors. The use of four conductors represents the maximum of conductors if, for security reasons, each contact is to be conductively connected to at least one second contact for signal and/or data transmission.

Another possible embodiment of the connector includes using a cable comprising as many conductors as plug and/or socket contacts. This embodiment allows connecting always two conductors in parallel to the corresponding plug and/or socket contacts. This interconnection ensures signal and/or data transmission not only when a plug and/or socket contact fails, but also when a conductor of the cable is damaged.

In order to ensure compatibility with other electrical connectors and to cover other fields of application, another embodiment includes designing the plug and the socket according to the RJ standard. The RJ standard permits several embodiments. If a plug and a socket are to be equipped with four contacts, the RJ9, RJ10 or RJ22 standards may be used. These standards are mainly used in communication technology.

The preferred standard for the inventive electrical connector is the RJ45 standard.

BRIEF DESCRIPTION OF THE DRAWINGS

The inventive subject matter will be explained in more detail in the following with reference to the schematic drawings, in which.

DETAILED DESCRIPTION OF THE INVENTION

Figure 1:
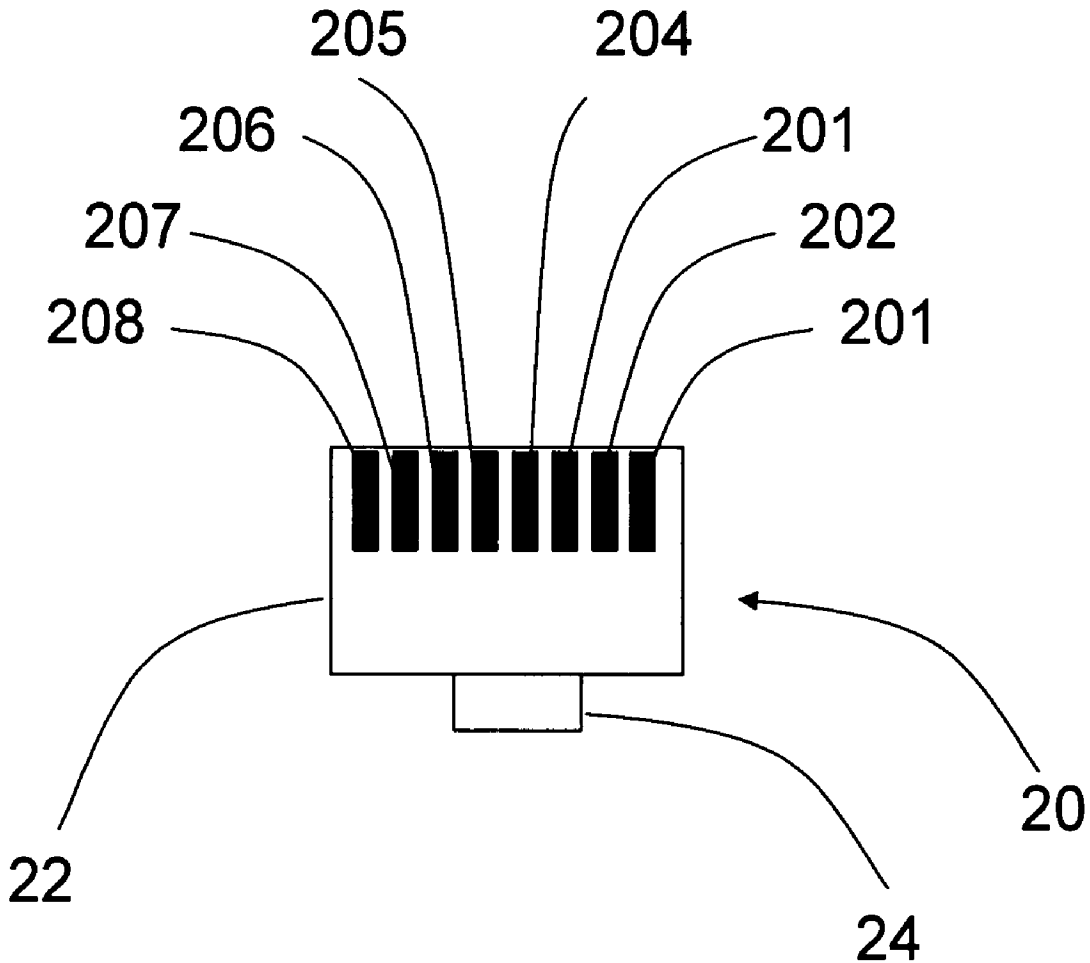
FIG. 1 shows a schematic front view of the plug.

Throughout the drawings, the same reference numerals are used for the same elements and components.

FIG. 1 shows a plug 20 compatible with the RJ45 standard. The plug 20 is provided with eight plug contacts 201 to 208, via which the control signals and/or data streams are transmitted. A plug lock 24 is arranged opposite to the plug contacts 201, 202, 203, 204, 205, 206, 207 and 208 on the plug housing 22, which allows locking the plug 20 in a suitably formed matching element (such as a socket 40). By locking the plug lock 24, the plug 20 is prevented from becoming detached and thus interrupting the control signals and/or data streams.

Figure 2:
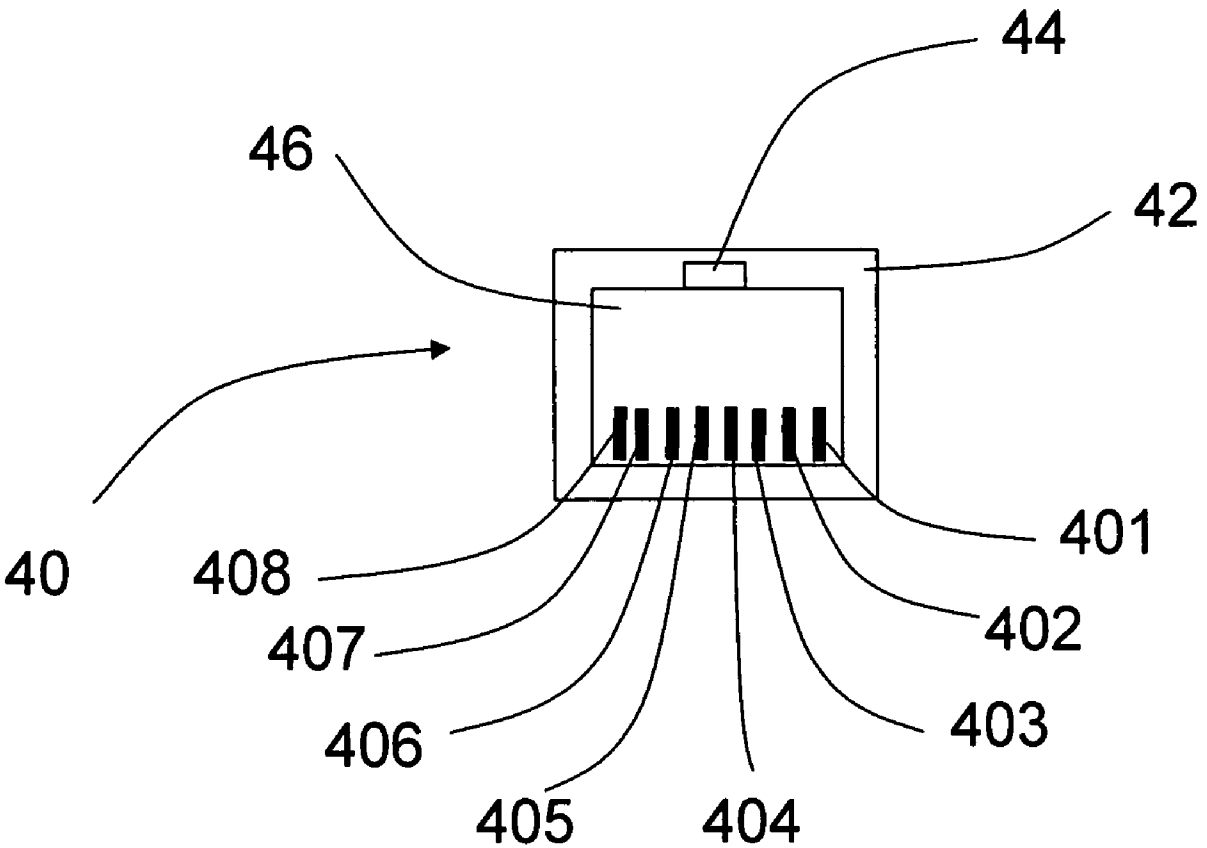
FIG. 2 shows a schematic front view of the socket.

FIG. 2 shows a socket 40 compatible with the RJ45 standard. The socket 40 matches the plug 20 described in FIG. 1. The socket 40 essentially consists of two basic components, the socket housing 42 and the plug receptacle 46. The socket 40 is provided with eight socket contacts 401 to 408 arranged in the plug receptacle 46. The control signals and/or data streams are transmitted via the socket contacts 401, 402, 403, 404, 405, 606, 407 and 408. A socket lock 44 arranged in the socket housing 42 receives the plug lock 24 described in FIG. 1. By locking the socket lock 44 with the plug lock 24, the plug 20 is prevented from becoming detached and thus interrupting the control signals and/or data streams.

Figure 3:
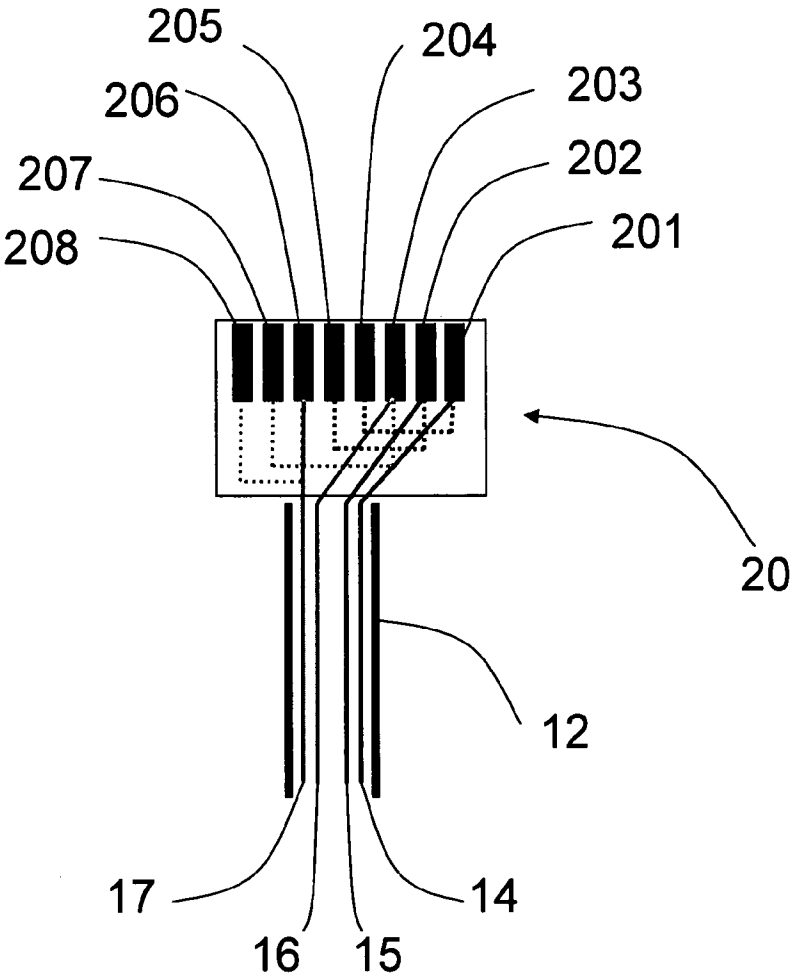
FIG. 3 shows a schematic illustration of the interconnections within the plug.

FIG. 3 shows the plug 20 and the cable 12 comprising a plurality of conductors 14, 15, 16 and 17. It further shows the plug contacts 201 to 208 and the interconnections among the plug contacts 201 to 208. The first conductor 14 of the cable 12 is connected to the first plug contact 201 conductively connected to the fourth plug contact 204. The second conductor 15 is connected to the second plug contact 202 conductively connected to the fifth plug contact 205. The third conductor 16 is connected to the third plug contact 203 conductively connected to the seventh plug contact 207. The fourth conductor 17 is connected to the sixth plug contact 206 conductively connected to the eighth plug contact 208.

Figure 4:
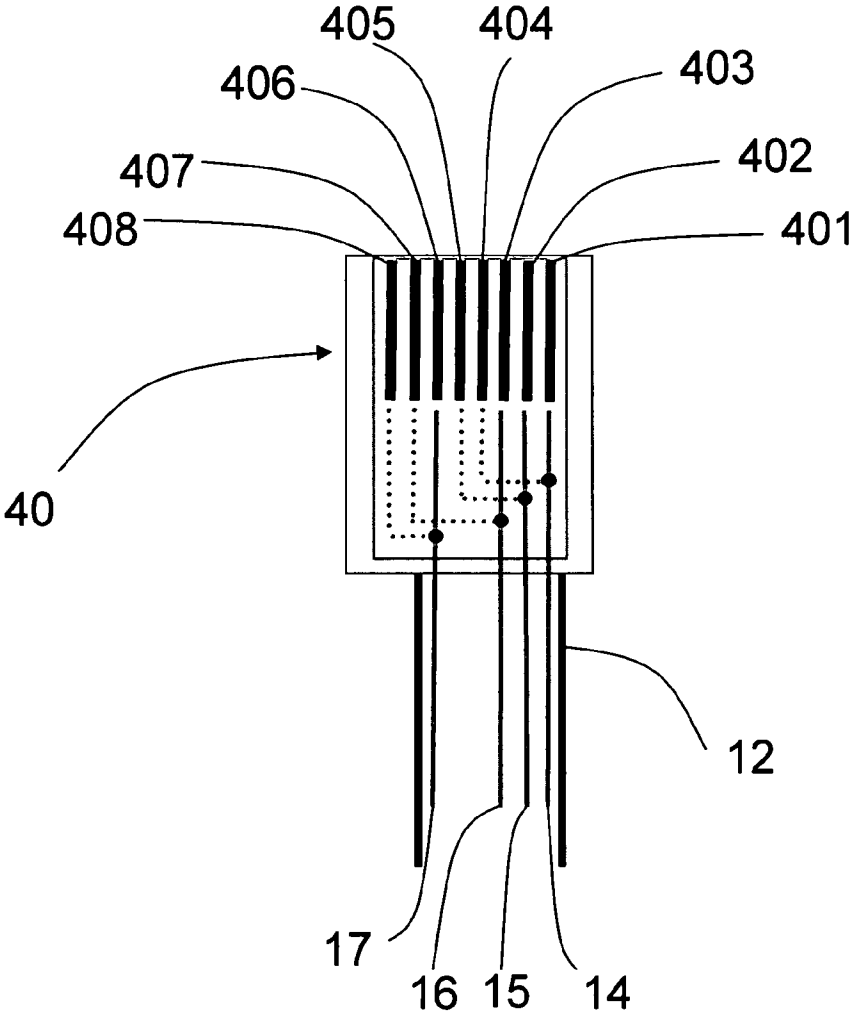
FIG. 4 shows a schematic illustration of the interconnections within the socket.

FIG. 4 shows the socket 40 with the cable 12, which is also provided with a plurality of conductors 14, 15, 16 and 17. It further shows the socket contacts 401 to 408 and the interconnections among the socket contacts 401 to 408. The first conductor 14 is connected to the first socket contact 401, which is connected to the fourth socket contact 404. The second conductor 15 is connected to the second socket contact 402, which is connected to the fifth socket contact 405. The third conductor 16 is connected to the third socket contact 403, which is connected to the seventh socket contact 407. The fourth conductor 17 is connected to the sixth socket contact 406, which is connected to the eighth socket contact 408.

The present invention comprises both a connector where the plug and socket each have their own cables, and thus a connection may be formed between the two, and a connector where the plug and socket can be attached to the same cable, for use for example an extension.

What is claimed is:

1. An electrical connector comprising:

a plug provided with a cable;

a socket provided with the cable or another cable, wherein the plug and the socket have an identical number of eight plug contacts and eight socket contacts, the cable and the other cable each having fewer conductors than the eight plug contacts or the eight socket contacts; and an electrical conductive connection between at least two of the plug contacts and a further electrical conductive connection between at least two of the socket contacts for ensuring a conductive connection of the eight socket contacts and the eight plug contacts so that at least one of signals and data are securely transmitted from the plug to the socket and for preventing at least one of signal and data loss in case of failure of one of the socket contacts, the cable and the other cable for the plug and the socket each including four conductors.

2. The electrical connector of claim 1, wherein the eight plug contacts include a first, a second, a third, a fourth, a fifth a, a sixth, a seventh and an eighth plug contact, the first plug contact and the fourth plug contact, the second plug contact and the fifth plug contact, the third plug contact and the seventh plug contact, and the sixth plug contact and the eighth plug contact being conductively connected.

3. The electrical connector of claim 2, wherein the first plug contact is closest to a first side of the plug and the eighth plug contact is closest to a second side of the plug and the second, third, fourth, fifth, sixth, and seventh plug contacts are sequentially in numerical order between the first plug contact and the eighth plug contact.

4. The electrical connector of claim 1, wherein the eight socket contacts include a first, a second, a third, a fourth, a fifth a, a sixth, a seventh and an eighth socket contact, the first socket contact and the fourth socket contact, the second socket contact and the fifth socket contact, the third socket contact and the seventh socket contact, and the sixth socket contact and the eighth socket contact being conductively connected.

5. The electrical connector of claim 4, wherein the first socket contact is closest to a first side of the socket and the eighth socket contact is closest to a second side of the socket and the second, third, fourth, fifth, sixth, and seventh socket contacts are sequentially in numerical order between the first socket contact and the eighth socket contact.

6. The electrical connector of claim 1, wherein the plug and the socket are compatible with the RJ45 standard.

7. The electrical connector of claim 1, wherein the socket is provided with the other cable.

8. The electrical connector of claim 1, wherein the socket is provided with the cable.

* * * * *